US005477697A

United States Patent [19]

Wharton et al.

[11] Patent Number: 5,477,697

[45] Date of Patent: Dec. 26, 1995

[54] APPARATUS FOR LIMITING COMPRESSOR DISCHARGE TEMPERATURES

[75] Inventors: Keith L. Wharton, Parkersburg; John H. Valence, Williamstown, both of W. Va.

[73] Assignee: Forma Scientific, Inc., Marietta, Ohio

[21] Appl. No.: 300,797

[22] Filed: Sep. 2, 1994

[51] Int. Cl.[6] ..... F25B 5/00; F25B 41/00

[52] U.S. Cl. ..... 62/117; 62/174; 62/196.4

[58] Field of Search ..... 62/DIG. 17, 196.4, 62/174, 117

[56] References Cited

U.S. PATENT DOCUMENTS

| | | | |
|---|---|---|---|
| 2,682,752 | 7/1954 | Branson | 62/1 |
| 3,736,763 | 6/1973 | Garland | 62/85 |
| 3,844,131 | 10/1974 | Gianni et al. | 62/149 |
| 4,096,706 | 6/1978 | Beckwith | 62/115 |
| 4,841,739 | 6/1989 | Wallner | 62/174 |
| 5,259,204 | 11/1993 | McKeown | 62/174 |
| 5,333,468 | 8/1994 | Rice | 62/174 |

FOREIGN PATENT DOCUMENTS

| | | | |
|---|---|---|---|
| 3721388 | 12/1988 | Germany | 62/174 |
| 287062 | 11/1990 | Japan | 62/174 |

OTHER PUBLICATIONS

Brochure, "American Laboratory", ISSN 0044–7749, vol. 16, No. 6, Jun. 1984.

FIG. 3, "Schematic diagram of mixed refrigerant auto–cascade system (MRA)", Cyrogenic.

*Primary Examiner*—William E. Wayner

*Attorney, Agent, or Firm*—Wood, Herron Evans

[57] ABSTRACT

A refrigeration system generally including a compressor, a condenser and an expansion device connected between the condenser and the low pressure, suction side of the compressor. A pressure control is disposed on the discharge or high pressure side of the compressor to selectively allow refrigerant to bleed from the high pressure side of the system. The control continuously monitors the pressure of the refrigerant discharging from the compressor and bleeds refrigerant off into a bypass, including an expansion tank and a bypass capillary tube, when a predetermined pressure is reached. The bypass capillary tube is connected between the expansion tank and the low pressure side or suction line of the system. When the control senses that the compressor discharge pressure has fallen below a preset pressure, the bleed off of refrigerant from the high pressure side of the system is stopped. Refrigerant vapor remaining in the bypass is slowly metered into the suction line due to a pressure differential therebetween. The control operates to repeat this process, as necessary.

22 Claims, 2 Drawing Sheets

APPARATUS FOR LIMITING COMPRESSOR DISCHARGE TEMPERATURES

BACKGROUND OF THE INVENTION

The present invention generally relates to the field of refrigeration systems and, more specifically, to a cascade refrigeration employing a peak control feature for monitoring and limiting the discharge pressure, and therefore the discharge temperature, of the low stage compressor in a two stage system.

Until recent years, chlorinated fluorocarbon (CFC) refrigerants had been widely used in a variety of refrigeration systems. Due to environmental concerns of such products, however, there has been a move to replace CFC's with other, more environmentally safe, refrigerants. In two stage cascade refrigeration systems, for example, the CFC refrigerant previously used in the high temperature stage part of the system may be replaced by the more environmentally safe R-134*a* without a significant adverse effect on the system. Low temperature stage CFC refrigerants such as R-503 are less easily replaced and, in fact, only one replacement, R-23, is currently available and approved for use in cascade refrigeration systems of the type contemplated herein.

Certain problems have arisen as a result of the transition to environmentally safe refrigerants. Most notably, in the low temperature stage portion of a cascade refrigeration system the replacement refrigerant has caused an unacceptable rise in compressor discharge pressure and temperature. This is especially true during start-up conditions and other high load situations, such as during high ambient temperature conditions. This reduces the efficiency of the system, i.e., makes the system work harder to achieve the desired temperature, and also adversely affects components within the low temperature stage compressor. In this latter regard, for example, typical compressors used in the low temperature stage have outlet valves which are designed to withstand temperatures up to about 160–165 degrees Celsius. Temperatures will exceed this maximum at a compressor discharge pressure of about 155 psig and above. With the use of the replacement refrigerant R-23, compressor discharge temperatures have been found to increase and easily exceed the temperature range necessary for preventing compressor outlet valve overheating and failure.

The above-mentioned problems in the art have not been adequately addressed during this changeover from CFC refrigerants to environmentally safe refrigerants. Certain proposed refrigeration or air conditioning systems, such as those disclosed in U.S. Pat. Nos. 4,841,739 and 5,259,204 have addressed the environmental hazards of CFC refrigerants by attempting to prevent blow-off of the refrigerant from the system into the atmosphere. Other systems have used pressure control features in attempting to increase the efficiency of system. However, none of these systems have addressed the problems presented by the use of newer, more environmentally safe refrigerants.

There is a need in the art, therefore, for a system which is able to use environmentally safe refrigerants while maintaining the desired system efficiency and also maintaining a long useful compressor life especially under adverse or high load operating conditions.

SUMMARY OF THE INVENTION

It has therefore been one object of the present invention to provide a refrigeration system capable of efficiently using an environmentally safe refrigerant.

It has been another object of the invention to safeguard the components of the system against adversely high working refrigerant temperatures, especially compressor discharge temperatures which would damage the outlet valve of the compressor.

It has been a further, more specific, object of this invention to provide a refrigeration system with a compressor discharge control which intermittently bleeds high pressure refrigerant from the compressor discharge line and continuously meters the refrigerant into a low pressure or suction side of the system.

To these ends, the present invention comprises a refrigeration system generally including a compressor, a condenser and an expansion device and evaporator connected between the condenser and the low pressure, input side of the compressor. In accordance with the principles of the present invention, a temperature and pressure control is disposed on the discharge or high pressure side of the compressor to selectively allow gaseous refrigerant to bleed from the compressor discharge line in an advantageous manner, Specifically, the control continuously monitors the pressure of the refrigerant discharging from the compressor and bleeds refrigerant into a bypass, including an expansion tank and a bypass capillary tube expansion device, when a predetermined pressure is reached or exceeded. The bypass capillary tube is connected between the expansion tank and the low pressure side or suction line of the system, i.e., the refrigerant line leading downstream from the system expansion device. When the control senses that the compressor discharge pressure has fallen below a preset pressure, the bleed off of gaseous refrigerant from the high pressure side of the system is stopped while gaseous refrigerant in the bypass continues to meter into the suction line through the bypass capillary tube. The control operates to repeat this process, as necessary, to maintain the compressor discharge pressure and temperature within respective preferred working ranges.

The control comprises an adjustable pressure switch that monitors the system pressure between the discharge side of the compressor and the input side of the condenser. The adjustable pressure switch operates a solenoid valve which is connected to the refrigerant line extending between the compressor discharge and the condenser input. The outlet of the solenoid valve communicates with both an expansion tank and with the low pressure side or suction line of the system. Thus, anytime there is refrigerant vapor in the bypass portion of the refrigeration system, and the refrigerant vapor is at a pressure higher than the pressure in the low pressure side or suction line of the refrigeration system, this refrigerant vapor will slowly meter back into the low pressure side of the system through the bypass capillary tube while excess refrigerant in the bypass will collect in the expansion tank.

The pressure switch may be adjusted to have two different pressure set points contained within a normal operating range of the system pressure. In the preferred embodiment of the invention, the upper discharge pressure set point is 155 psig which corresponds to a maximum temperature at the discharge valves of the compressor of about 163 degrees Celsius. The lower set point is 130 psig. This lower set point causes the discharge valve temperature to remain at 163 degrees Celsius or below while still maintaining the efficiency of the system. When the compressor discharge pressure reaches or exceeds 155 psig, the pressure switch closes and the solenoid is energized to open and thereby bleed refrigerant into the bypass, including the expansion tank and bypass capillary tube. When the compressor discharge pressure then reaches or falls below 130 psig, the pressure switch opens, deenergizing the solenoid valve, and stopping the flow of refrigerant from the high pressure side of the refrigeration system to the bypass.

In the preferred embodiment, the refrigeration system comprises a two stage cascade refrigeration system, i.e., a refrigeration system having a high temperature stage system coupled with a low temperature stage system. Each stage preferably utilizes a separate system capillary expansion device. The pressure control or "peak control" of the present invention is advantageously incorporated into the low temperature stage system to thereby control the discharge pressure and temperature of the low stage compressor, to remain within respective ranges optimizing refrigeration efficiency yet preventing harmful overheating of system components, especially the low stage compressor outlet or discharge valves.

Further objects and advantages of the present invention will become more readily apparent to those of ordinary skill in the art upon review of the following detailed description taken in conjunction with the accompanying drawings.

DETAILED DESCRIPTION OF THE PREFERRED EMBODIMENTS

Figure 1:
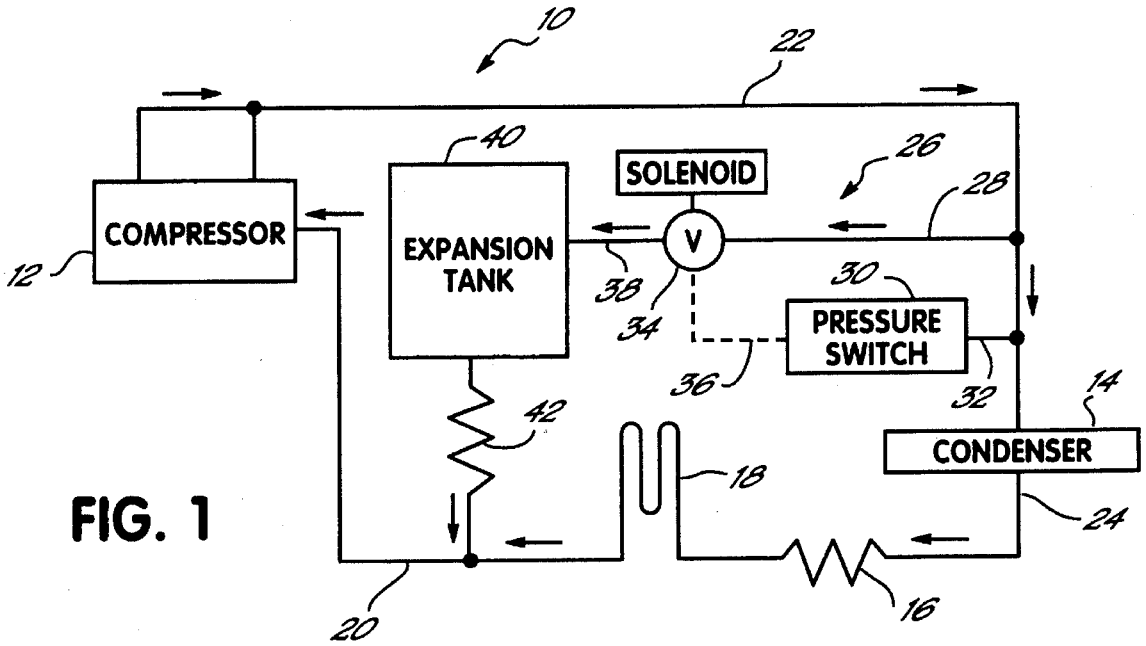
FIG. 1 is a block diagram of a basic single stage refrigeration system incorporating the peak control system of the present invention.

Referring first to FIG. 1, a basic system diagram of a single stage refrigeration system 10 is illustrated and includes a bypass control or "peak control" portion in accordance with the principles of the present invention. It will be readily appreciated that only the main components of system 10 have been shown for clarity and that further standard components such as fans, valves, etc., would be added to the system, as necessitated by particular applications. Refrigeration system 10 generally comprises standard refrigeration or heat exchange components including a compressor 12, condenser 14, expansion device 16 and evaporator 18. Compressor 12 is driven by a conventional electric motor (not shown) and operates to draw refrigerant vapor through suction line 20, compress the refrigerant vapor and then discharge it into the high pressure side of system 10, specifically into compressor discharge line 22. The refrigerant vapor is cooled and liquified in condenser 14 and is discharged into line 24 leading to expansion device 16. Expansion device 16 is preferably a capillary tube for allowing a constant flow of liquid refrigerant to expand in evaporator 18. In a conventional manner, evaporator 18 cools the refrigerated space of, for example, a freezer by means of a cold wall (not shown). Alternatively, room air may be directed across the evaporator coil by way of one or more fans (not shown) to cool the same before it enters the intended refrigerated space. Evaporator 18 discharges gaseous refrigerant into suction line 20 and the cycle repeats.

Figure 1A:
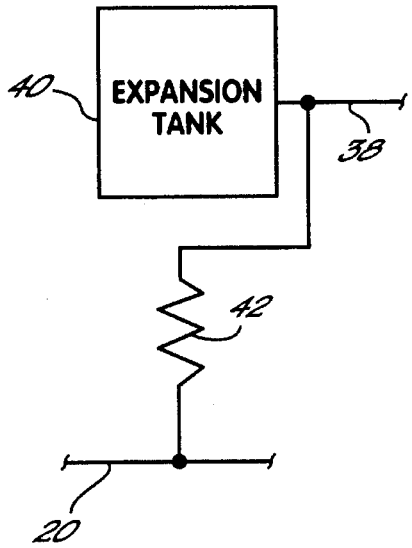
FIG. 1A is a modified portion of the block diagram shown in FIG. 1 showing an alternative connection of the by-pass capillary tube of the present invention.

In accordance with the principles of the present invention, a bypass or "peak control" system 26 is provided in system 10 for maintaining the compressor discharge pressure in compressor discharge line 22 within a predetermined operating range. Peak control system 26 includes a bypass refrigerant vapor line 28 connected to discharge line 22 of compressor 12 intermediate compressor 12 and condenser 14. An adjustable pressure switch 30 is also operatively connected to compressor discharge line 22 by a fluid line 32. Of course, line 32 could alternatively be connected to line 28 while still achieving its function. In this regard, pressure switch 30 functions to activate and deactivate a solenoid valve 34 by way of an electrical connection 36 in response to pressure changes in compressor discharge line 22 as will be explained further below. An outlet of solenoid valve 34 is connected to a line 38 leading to an expansion tank 40 and further leading to a bypass capillary tube expansion device 42. As shown in FIG. 1A, bypass capillary tube 42 may alternatively be connected directly to line 38 while maintaining a free and open path for line 38 to expansion tank 40 for purposes of containing excess refrigerant in the bypass or "peak control" system.

Pressure switch 30 monitors the pressure of compressor discharge line 22 and therefore the discharge pressure of compressor 12. Pressure switch 30 closes when the discharge pressure of compressor 12 reaches a predetermined high working pressure set point which may be, for example, 155 psig. When pressure switch 30 closes, normally closed solenoid valve 34 is energized and thereby opened to allow high pressure refrigerant to flow from compressor discharge line 22, through lines 28 and 38, and into expansion tank 40. Refrigerant is subsequently slowly metered back into suction line 20 through capillary tube 42 in a continuous manner as long as a pressure differential exists between tank 40 and suction line 20. When the pressure in compressor discharge line 22 drops to a low pressure set point of pressure switch 30 which may be, for example, 130 psig, pressure switch 30 opens, thereby de-energizing and closing solenoid valve 34 and stopping the flow of refrigerant vapor past valve 34 and into tank 40.

As the discharge pressure of compressor 12 in compressor discharge line 22 elevates to a value equal to the high pressure set point of pressure switch 30, the peak control process will repeat itself until evaporator 18 is cold enough to allow the discharge pressure in compressor discharge line 22 to remain below the high pressure set point, i.e., 155 psig in the illustration mentioned above. It will be appreciated that under high load conditions, such as when system 10 is exposed to high ambient temperatures or during initial start up of system 10, pressure switch 30 will be opening and closing at an increased rate to maintain the discharge pressure of compressor 12 below the predetermined threshold limit or set point. However, when system 10 is running in lower load conditions, pressure switch 30 will be opening and closing less frequently because evaporator 18 will remain cooler under such load conditions. As mentioned above, pressure switch 30 is preferably adjustable such that the high and low pressure set points may be advantageously adjusted in accordance with the needs of a particular application for system 10.

Figure 2:
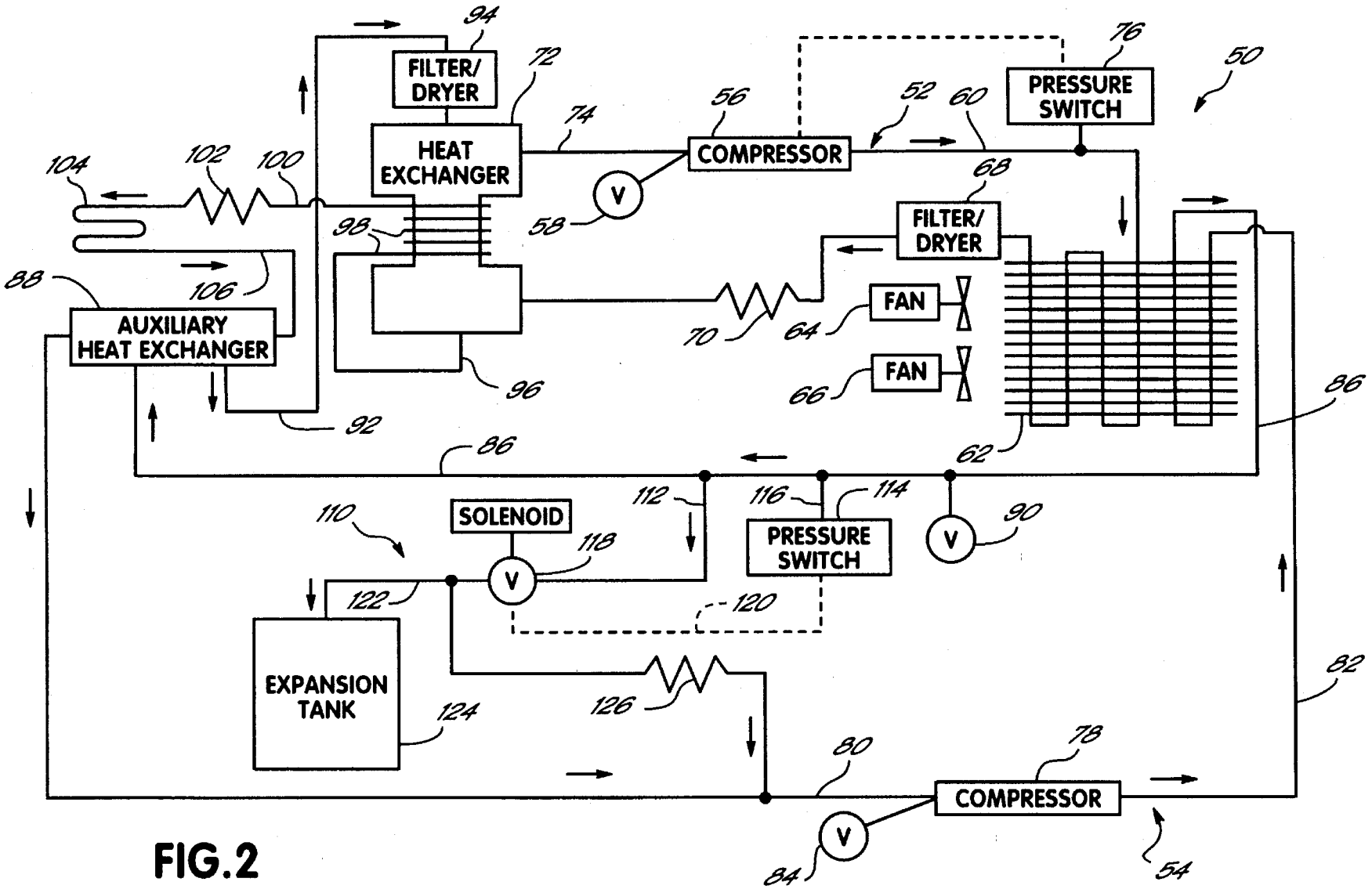
FIG. 2 is a block diagram of a two stage cascade refrigeration system of the preferred embodiment of the invention incorporating the peak control system.

FIG. 2 is a block diagram of the preferred manner of incorporating the present invention into a two stage cascade refrigeration system 50. Specifically, system 50 includes a high temperature stage portion 52 and a low temperature stage portion 54. Such a two stage system is useful in freezer units designed for ultra low temperature applications, e.g., those applications requiring temperatures to be maintained in a range of about −50° C. to −90° C. In this regard, the high temperature stage portion 52 functions to bring the temperature of the system down to an initial level and the low temperature stage portion 54 then brings the temperature of the system down to the required temperature. These two stage systems are generally known in the art and therefore the following detailed description focuses mainly on the inclusion of the "peak control" components of the present invention in system 50 and certain conventional components, such as vibration isolation coils, oil separators, strainers, etc., which may normally be contained in two stage cascade refrigeration systems, have been left off of FIG. 2 for clarity.

High temperature stage portion 52 of refrigeration system 50 comprises a high stage compressor 56, having a standard suction service valve 58 connected to its inlet, discharges high pressure, high stage refrigerant, such as R-134*a* refrigerant, into high pressure line 60. High pressure line 60 leads to air cooled condenser 62 which discharges liquid refrigerant under pressure through filter/dryer 68 and into the inlet of a capillary tube expansion device 70. As is conventional, the coils of condenser 62 are cooled by electric fans 64, 66. Capillary tube 70 then discharges low pressure refrigerant into heat exchanger 72 which, in the high temperature stage portion 52 of system 50 acts as an evaporator. Heat exchanger 72 discharges refrigerant vapor into suction line 74 from which compressor 56 draws refrigerant to again cycle through high temperature stage portion 52 of system 50.

A pressure switch 76 is disposed in the high pressure line 60 between compressor 56 and condenser 62. Pressure switch 76 serves as a precautionary measure to prevent over-pressurization of high temperature stage portion 52. Preferably, pressure switch 76 shuts down high stage compressor 56 if a predetermined unsafe pressure is reached in high pressure line 60. This predetermined pressure limit may, for example, be about 350 psig.

Low temperature stage portion 54 is generally comprised of a low stage compressor 78 which draws low stage refrigerant vapor, such as R-23 refrigerant, from suction line 80, compresses the refrigerant vapor, and discharges it into discharge line 82. As with the first embodiment, low stage compressor 78 preferably includes a conventional suction service valve 84 connected on an inlet side thereof. Compressor discharge line 82 leads to air cooled condenser 62 which functions as both the condenser for high temperature stage portion 52 and a desuperheating condenser for low stage refrigerant directed under pressure into high pressure line 86. High pressure refrigerant line 86 leads from condenser 62 to an auxiliary heat exchanger 88, which may serve as a second, desuperheating condenser to further cool the low stage refrigerant which at this point in the system is still in vapor phase. Line 86 may also include an access or service valve 90 as is conventional. A discharge line 92 takes the low stage refrigerant from auxiliary heat exchanger 88, through a filter/dryer 94 and through heat exchanger 72 which serves as the main condenser for low temperature stage portion 54. The low stage refrigerant passes through lines 96, 98 and 100 to the low stage capillary tube expansion device 102. In the embodiment shown in FIG. 2, lines 98 and 100 actually comprise one long capillary tube and form part of capillary tube expansion device 102. From capillary tube expansion device 102, the low stage refrigerant expands in an evaporator 104 and, by way of line 106, is directed back through auxiliary heat exchanger 88, which preferably serves as a secondary evaporator in this section of the low temperature stage portion 54. Low stage refrigerant vapor exits auxiliary heat exchanger 88 into suction line 80 and is again drawn into low stage compressor 78.

A peak control system 110, arranged essentially in accordance with the peak control system 26 of FIG. 1, is incorporated into the low temperature stage portion 54 of refrigeration system 50. Preferably, peak control system 110 is incorporated into low temperature stage portion 54 so as to create a bypass from high pressure line 86 to suction line 80, i.e., a bypass located between condenser 62 and auxiliary heat exchanger 88. In accordance with the present invention, peak control system 110 maintains the compressor discharge pressure in high pressure lines 82 and 86 within a predetermined operating range.

Peak control system 110 includes a bypass refrigerant vapor line 112 connected to high pressure line 86 leading from condenser 62, specifically between condenser 62 and auxiliary heat exchanger 88. An adjustable pressure switch 114 is also operatively connected to high pressure line 86 by a fluid line 116. Pressure switch 114 functions to activate and deactivate a solenoid valve 118, by way of an electrical connection 120, in response to pressure changes in high pressure line 86. An outlet of solenoid valve 118 is connected to a line 122 leading to an expansion tank 124. A bypass capillary tube expansion device 126 is also connected between line 122 and suction line 80 of low temperature stage portion 54.

Pressure switch 114 monitors the pressure of high pressure line 86 and therefore the discharge pressure of compressor low stage compressor 78. Pressure switch 114 closes when the discharge pressure of compressor 78 reaches a predetermined high pressure set point which may be, for example, 155 psig. When pressure switch 114 closes, normally closed solenoid valve 118 is energized and thereby opened to allow high pressure, gaseous low stage refrigerant, which is substantially at room temperature at this point in low stage portion 54 of system 50, to flood into expansion tank 124 through line 122. This effectively removes low stage refrigerant from low temperature stage portion 54 which results in a drop in the discharge pressure of low stage compressor 78 and a slow down of the mass flow through low temperature stage portion 54 thereby reducing the load on compressor 78.

When the pressure in high pressure line 86 falls to a value equal to the low pressure set point of pressure switch 114 which may be, for example, 130 psig, pressure switch 114 opens, thereby de-energizing and closing solenoid valve 118 and stopping the flow of refrigerant vapor past valve 118 and into tank 124. After solenoid valve 118 closes, low stage refrigerant contained in tank 124 is slowly metered back into the low temperature stage portion 54 of system 50 in a continuous manner through capillary tube expansion device 126.

As the discharge pressure of low stage compressor 78, and therefore the pressure in high pressure line 86 elevates to the high pressure set point of pressure switch 114, the peak control process will repeat itself until evaporator 104 is cold enough to allow the discharge pressure in high pressure line 86 to remain below the high pressure set point, i.e., 155 psig in the illustration mentioned above. As with the first embodiment, under high load conditions, such as when system 50 is exposed to high ambient temperatures or during initial start-up of system 50, pressure switch 114 will be opening and closing at an increased rate to maintain the discharge pressure of low stage compressor 78 below the predetermined threshold limit or set point. However, when system 50 is running in lower load conditions, pressure switch 114 will be opening and closing less frequently because evaporator 104 will remain cooler under such load conditions. As mentioned above, pressure switch 114 is preferably adjustable such that the high and low pressure set points may be advantageously adjusted in accordance with the needs of a particular application for system 50. These set points may be adjusted according to the needs of the particular application. For example, for a two stage system constructed generally in the manner described in connection with FIG. 2, respective pressure set points of 130 psig and 155 psig have been found to be suitable for an ultra low temperature freezer wherein discharge valves in the low stage compressor 78 are rated to withstand a maximum temperature of 163° C. With this particular two stage system, it has been found that this maximum temperature will not be exceeded as long as the pressure detected by pressure switch 114 does not exceed 155 psig.

From the foregoing description of the above refrigeration systems, it will be appreciated that the peak control system of the present invention is effective to protect system components, such as some system valves, from the damaging effects of heat build-up due to high compressor discharge pressure. At the same time, the peak control system of the present invention serves to maintain the system efficiency necessary to achieve desired temperatures for a given application.

While preferred embodiments of the invention have been shown and described in detail above, modifications and substitutions of various parts thereof will be readily appreciated by those of ordinary skill. Applicant therefore intends not to be bound by the details provided herein but only by the legal scope of the claims appended hereto.

What is claimed is:

1. A refrigeration system comprising:

(a) a compressor having an inlet and an outlet and a discharge line connected to said outlet;

(b) a condenser connected to said discharge line of said compressor for receiving compressed refrigerant vapor from said compressor;

(c) a system expansion device having an inlet connected to a discharge of said condenser, said system expansion device defining a high pressure portion of said system between said compressor outlet and said system expansion device inlet and a low pressure portion of said system defined by a suction line extending between an outlet of said system expansion device and said compressor inlet;

(d) an evaporator operatively connected between an outlet of said system capillary tube expansion device and an inlet of said compressor;

(e) a compressor discharge pressure and temperature control including:

(i) a pressure sensing mechanism connected to the discharge line of said compressor for monitoring compressor discharge pressure;

(ii) a bypass refrigerant vapor line connected between the discharge line of said compressor and said suction line, said bypass refrigerant vapor line including a valve for controlling fluid flow therein;

(iii) a valve control operatively connected to both said pressure sensing mechanism and said valve, said valve control operative to open said valve to allow continuous flow of refrigerant through said bypass refrigerant vapor line when said pressure sensing mechanism detects a first pressure and to close said valve when said pressure sensing mechanism detects a second, lower pressure; and, wherein said system is a two stage system having both a high temperature stage portion and a low temperature stage portion, said compressor discharge pressure and temperature control being part of said low temperature stage portion.

2. The refrigeration system of claim 1 wherein said pressure sensing mechanism comprises a pressure switch and said valve control comprises a solenoid operatively connected to said valve for opening and closing said valve, said pressure switch having high and low pressure set points corresponding respectively to said first and second pressures.

3. The refrigeration system of claim 2 wherein said pressure switch is adjustable to vary said high and low pressure set points.

4. The refrigeration system of claim 1 wherein said system expansion device is a capillary tube expansion device.

5. The refrigeration system of claim 1 wherein said bypass refrigerant vapor line includes a bypass capillary tube expansion device connected at its inlet end downstream of said valve.

6. The refrigeration system of claim 5 wherein said system expansion device is a capillary tube expansion device.

7. The refrigeration system of claim 5 wherein said valve and said bypass capillary tube expansion device are both further connected to an expansion tank.

8. The refrigeration device of claim 7 wherein said expansion tank is connected downstream of said valve and upstream of said bypass capillary tube expansion device.

9. The refrigeration system of claim 1 further comprising at least two condensers contained in said low temperature stage portion, wherein a first condenser is connected to the discharge line of said compressor and a second condenser is connected downstream of said first condenser, said pressure sensing mechanism and said bypass refrigerant vapor line being coupled to a refrigerant line extending between said first and second condensers.

10. The refrigeration system of claim 9 wherein said second condenser is part of a dual function heat exchanger operatively coupled to both said high temperature stage portion and said low temperature stage portion, said heat exchanger operating as an evaporator for said high temperature stage and as a condenser for said low temperature stage portion.

11. The refrigeration system of claim 1 wherein said valve and said bypass refrigerant vapor line are both further connected to an expansion tank.

12. The refrigeration system of claim 1 further comprising at least two condensers contained in said low temperature stage portion, wherein a first condenser is connected to the discharge line of said compressor and a second condenser is connected downstream of said first condenser, said pressure sensing mechanism and said bypass refrigerant line being coupled to a refrigerant line extending between said first and second condensers.

13. The refrigeration system of claim 12 wherein said second condenser is part of a dual function heat exchanger operatively coupled to both said high temperature stage portion and said low temperature stage portion, said heat exchanger operating as an evaporator for said high temperature stage and as a condenser for said low temperature stage portion.

14. A refrigeration system comprising:

(a) a compressor having an inlet and an outlet and a discharge line connected to said outlet;

(b) a condenser connected to said discharge line of said compressor for receiving compressed refrigerant vapor from said compressor;

(c) a system capillary tube expansion device having an inlet connected to a discharge of said condenser, said system capillary tube expansion device defining a high pressure portion of said system between said compressor outlet and said capillary tube system expansion device inlet and a low pressure portion of said system defined by a suction line extending between an outlet of said system capillary tube expansion device and said compressor inlet;

(d) an evaporator operatively connected between an outlet of said system capillary tube expansion device and an inlet of said compressor;

(e) a compressor discharge pressure and temperature control including:

(i) a pressure sensing mechanism operatively connected to said high pressure portion of said system for monitoring pressure in said high pressure portion;

(ii) a bypass refrigerant vapor line connected to the discharge line of said compressor between said compressor and said condenser and further connected to said suction line downstream of said evaporator, said bypass refrigerant vapor line including a valve for controlling fluid flow therein, an expansion tank connected downstream of said valve, and a bypass capillary tube expansion device connected downstream of said valve;

(iii) a valve control operatively connected to both said pressure sensing mechanism and said valve, said valve control operative to open said valve to allow continuous flow of refrigerant vapor from said discharge line into said bypass refrigerant vapor line when said pressure sensing mechanism detects a first pressure and to close said valve when said pressure sensing mechanism detects a second, lower pressure; and, wherein said system is a two stage system having both a high temperature stage portion and a low temperature stage portion, said compressor discharge pressure and temperature control being part of said low temperature stage portion.

15. The refrigeration system of claim 14 further comprising at least two condensers contained in said low temperature stage portion, wherein a first condenser is connected to the discharge line of said compressor and a second condenser is connected downstream of said first condenser, said pressure sensing mechanism and said bypass fluid line being coupled to a refrigerant line extending between said first and second condensers.

16. The refrigeration system of claim 15 wherein said second condenser is part of a dual function heat exchanger operatively coupled to both said high temperature stage portion and said low temperature stage portion, said heat exchanger operating as an evaporator for said high temperature stage and as a condenser for said low temperature stage portion,

17. A method of controlling compressor discharge pressure and temperature of refrigerant in a two stage refrigeration system having a high temperature stage portion and a low temperature stage portion, the method comprising the steps of:

monitoring gaseous refrigerant pressure in a compressor discharge line in the low temperature stage portion of said refrigeration system at a location between a compressor and a condenser in the low temperature stage portion of said system;

opening a valve contained in a bypass fluid line leading between said compressor discharge line and a suction line in the low temperature stage portion of said system when said pressure reaches a first pressure;

collecting gaseous refrigerant from said bypass fluid line;

metering said gaseous refrigerant into said suction line; and, closing said valve when said discharge pressure drops to a second pressure lower than said first pressure.

18. The method of claim 17 wherein the step of collecting said gaseous refrigerant further comprises collecting said gaseous refrigerant into an expansion tank connected with an outlet of said valve.

19. The method of claim 18 wherein the step of metering said gaseous refrigerant further comprises continuously directing said gaseous refrigerant through a capillary tube.

20. The method of claim 17 wherein the step of metering said gaseous refrigerant further comprises continuously directing said gaseous refrigerant through a capillary tube.

21. The method of claim 17 wherein said first pressure is approximately 155 psig.

22. The method of claim 21 wherein said second pressure is approximately 130 psig.

* * * * *